US010615522B2

(12) United States Patent
Marmonier et al.

(10) Patent No.: US 10,615,522 B2
(45) Date of Patent: Apr. 7, 2020

(54) CONNECTION SYSTEM FOR A RING TERMINAL WITH A CLAMPING MEANS AND HOLDING MEANS FOR HOLDING THE RING TERMINAL PRIOR TO CLAMPING

(71) Applicant: Schneider Electric Industries SAS, Rueil-Malmaison (FR)

(72) Inventors: Jean Marmonier, Saint Aunes (FR); Marnix Van Der Mee, Montlouis sur Loire (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 322 days.

(21) Appl. No.: 15/261,098

(22) Filed: Sep. 9, 2016

(65) Prior Publication Data

US 2017/0077624 A1 Mar. 16, 2017

(30) Foreign Application Priority Data

Sep. 11, 2015 (FR) ..... 15 58492

(51) Int. Cl.
*H01R 43/00* (2006.01)
*H01R 9/24* (2006.01)
(Continued)

(52) U.S. Cl.
CPC ..... *H01R 9/2416* (2013.01); *H01R 4/305* (2013.01); *H01R 4/4809* (2013.01); *H01R 11/12* (2013.01);
(Continued)

(58) Field of Classification Search
CPC ..... H02J 7/0042; H02J 3/382; H02J 3/383; H02J 50/10; H02J 7/0013; H02J 7/0044;
(Continued)

(56) References Cited

U.S. PATENT DOCUMENTS 6,188,560 B1 * 2/2001 Waas ..... H01R 4/2408 361/119
6,293,830 B1 * 9/2001 Park ..... H01R 9/26 439/709
(Continued)

FOREIGN PATENT DOCUMENTS

JP 5-326053 12/1993
JP 3198296 U 6/2015
(Continued)

OTHER PUBLICATIONS

KR20100016168A_TRANSLATED.*
(Continued)

*Primary Examiner* — Thiem D Phan
(74) *Attorney, Agent, or Firm* — Oblon, McClelland, Maier & Neustadt, L.L.P.

(57) ABSTRACT

A connecting system for a ring terminal for a baseplate of a terminal block comprises holding means for the terminal, and a clamping device configured to clamp the ring terminal once the ring terminal is held. The connecting system is configured such that the ring terminal bearing against at least one of the holding means generates a relative gap of the holding means with respect to each other, and then to move the holding means closer to each other, under the bias of a spring member when the holding means are located facing the ring of the terminal, so as to hold the ring terminal.

18 Claims, 4 Drawing Sheets

(51) Int. Cl.

| | |
|---|---|
| ***H01R 11/12*** | (2006.01) |
| ***H01R 4/30*** | (2006.01) |
| ***H01R 4/48*** | (2006.01) |
| ***H01R 43/20*** | (2006.01) |

(52) U.S. Cl.
CPC ..... *H01R 43/20* (2013.01); *Y10T 29/49174* (2015.01)

(58) Field of Classification Search
CPC ..... H02J 7/0045; H02J 7/0047; H02J 7/0065; H02J 7/0068; H02J 7/007; H02J 7/35; H02J 9/00; H02J 3/387; H01R 9/2416; H01R 4/305; H01R 4/4809; H01R 11/12; H01R 43/20; H01R 9/2491; H01R 12/515; Y10T 29/49117; Y10T 29/49174; Y10T 29/53235; Y10T 29/5193
USPC ..... 439/709, 137, 291, 373, 412, 460, 487, 439/500, 651, 701, 801, 949; 174/135, 174/520, 53; 361/119; 29/857, 842, 861, 29/863, 865
See application file for complete search history.

(56) References Cited

U.S. PATENT DOCUMENTS

| | | | | |
|---|---|---|---|---|
| 7,011,551 | B2 * | 3/2006 | Johansen | H01R 9/2641 439/709 |
| 8,241,071 | B1 * | 8/2012 | Hayama | H01R 4/34 439/709 |
| 2015/0118889 | A1 | 4/2015 | Assif et al. | |

FOREIGN PATENT DOCUMENTS

| | | | | |
|---|---|---|---|---|
| KR | 20100016168 | * | 2/2010 | H01R 4/301 |
| WO | WO 2008/134992 | A1 | 11/2008 | |
| WO | WO 2011/106935 | A1 | 9/2011 | |

OTHER PUBLICATIONS

French Preliminary Search Report dated Jun. 30, 2016 in French Application 15 58492, filed on Sep. 11, 2015 ( with English Translation of Categories of Cited Documents).

* cited by examiner

CONNECTION SYSTEM FOR A RING TERMINAL WITH A CLAMPING MEANS AND HOLDING MEANS FOR HOLDING THE RING TERMINAL PRIOR TO CLAMPING

TECHNICAL FIELD

The invention relates to the connection of a ring terminal of a female electrical connector to a baseplate of a terminal block of a system for acquiring low voltage signals. An exemplary application of the invention is found in particular in protection and control equipment, in particular for a medium or high voltage electrical facility.

BACKGROUND OF THE INVENTION

Female electrical connectors comprise a ring terminal to be securely mechanically and electrically connected to a baseplate of a terminal block.

Known connecting systems conventionally comprise a screw and a nut to clamp the ring terminal to a conductive support tab. However, the clamping of the ring terminal through a screw and a nut makes the connection of the ring terminal relatively long and complex to implement.

From document US 2015/0118889 A1, it is known a connecting device comprising an elastic arm rotatably movable under the effect of a cam pivoting, to attach the ring terminal to a support tab. The cam pivots towards the ring terminal when the screw is clamped in the casing of the connecting device.

In such a device, the ring terminal is only properly held with respect to the support tab when the ring terminal is attached to this tab through clamping, which makes the connection of the ring terminal rather difficult.

DISCLOSURE OF THE INVENTION

The invention aims at solving at least partially the problems met in solutions from prior art.

In this regards, one object of the invention is to provide a system for connecting a ring terminal for a baseplate of a terminal block. The connecting system comprises:

an electrical connecting member for the terminal, a first and a second holding means for the terminal, and a spring member configured to bias the holding means one towards the other.

The connecting system is configured such that the ring terminal bearing against at least one of the holding means generates a relative gap of the holding means one with respect to the other.

The connecting system is further configured to move the holding means closer to each other thereafter, under the bias of the spring member when the holding means are located facing the ring of the terminal, such that they hold the ring terminal relative to the connecting member.

The connecting system also comprises a means for clamping the ring terminal configured to attach the ring terminal relative to the electrical connecting member, once the ring terminal is held by the holding means.

The connecting system enables the ring terminal to be more easily connected, while ensuring a satisfactory security for the staff intervening for connecting/separating the ring terminal.

The connecting system is in particular capable of holding the ring terminal independently of its attachment through clamping.

The invention can optionally include one or more of the following characteristics combined with each other or not.

Advantageously, the electrical connecting member comprises a support tab on which the ring terminal is intended to bear. This support tab is preferably threaded to enable the ring terminal to be clamped to the support tab through a screw.

According to an embodiment feature, the holding means bear against each other through the ring of the ring terminal, when they hold the ring terminal relative to the connecting member.

According to an advantageous embodiment, at least one of the holding means comprises an end portion the transverse cross-section of which is narrowed towards the other of the holding means, to facilitate the insertion of the ring terminal between the holding means. Preferably, the end portion of at least one of the holding means ends as a tip towards the other of the holding means.

Preferably, the connecting system comprises a guide means configured to guide the displacement of at least one of the holding means towards the other of the holding means, the guide means preferably comprising a conduit.

The guide means is preferably configured to translationally guide the holding means with respect to each other such that they are aligned along a substantially vertical direction.

According to another advantageous embodiment, the connecting system comprises a housing for at least one of the holding means, where the holding means is at least partially accommodated and maintained when the ring terminal is separated from the connecting system.

The housing makes this holding means substantially not losable, when the ring terminal is separated from the connecting system.

According to another embodiment feature, at least one of the holding means comprises a screw, which preferably forms at least partially the clamping means, and/or one of the holding means comprises a pin.

The invention is also concerned with a baseplate for a terminal block comprising a plurality of connecting systems as defined above, the connecting systems being aligned on at least one side of the baseplate and configured to mechanically and electrically connect ring terminal female electrical connectors to the terminal block.

The invention also relates to a method for connecting a ring terminal to a baseplate by means of a connecting system as defined above, comprising:

a step of inserting the ring terminal between the holding means of the ring terminal, during which the ring terminal bears on at least one of the holding means by moving the holding means away from each other, and then during which the holding means are moving closer to each other, under the bias of the spring member when the holding means are located facing the ring terminal, for holding the ring terminal relative to the connecting member, a step of attaching the ring terminal relative to the connecting member through clamping, once the ring terminal is held with respect to the connecting member.

According to an embodiment feature, the holding means are configured to bear against each other during the step of attaching the ring terminal through clamping.

BRIEF DESCRIPTION OF DRAWINGS

The present invention will be better understood upon reading the description of exemplary embodiments, given by way of purely indicating and in no way limiting purposes, making reference to the appended drawings in which.

DETAILED DISCLOSURE OF PARTICULAR EMBODIMENTS

Figure 1:
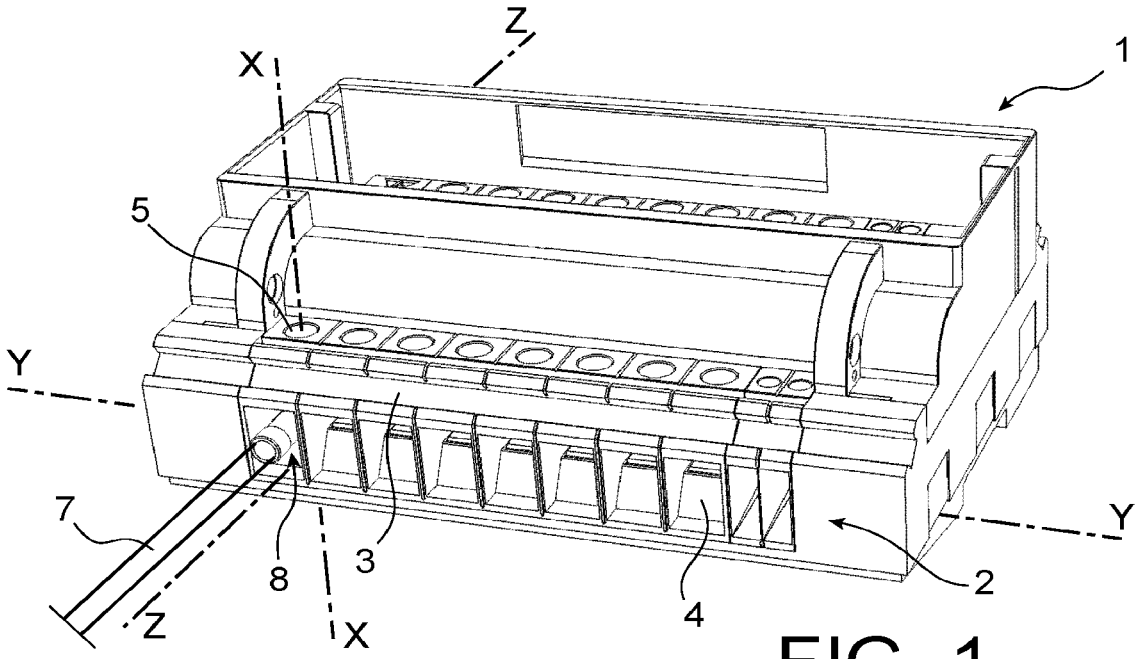
FIG. 1 is a partial elevation representation of a baseplate for a terminal block and a female electrical connector connected to the baseplate, according to a first embodiment of the invention.
Figure 2:
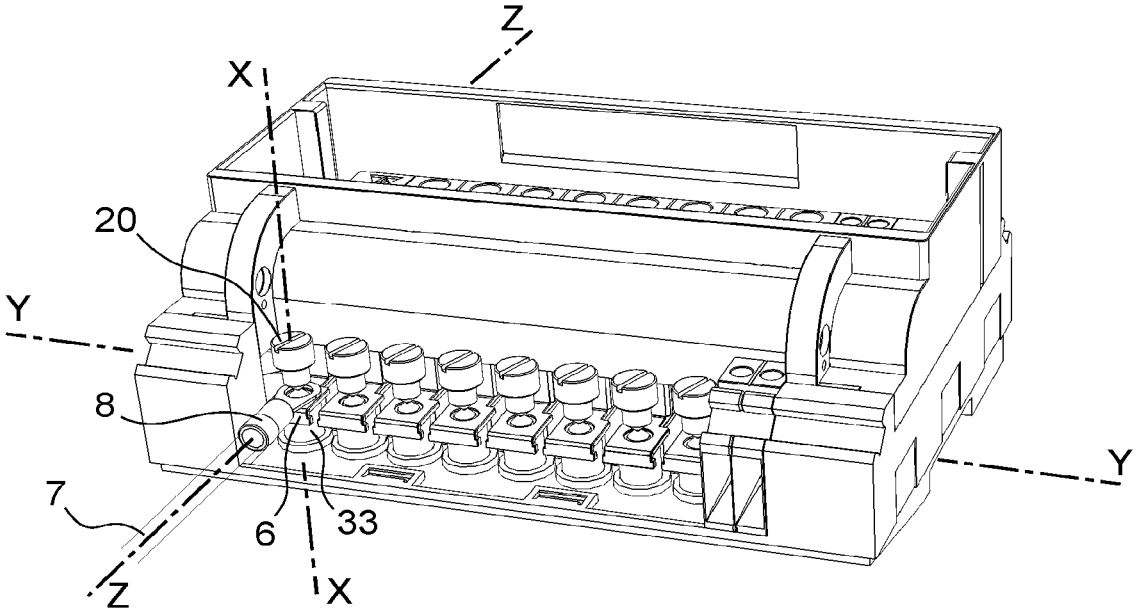
FIG. 2 is a partial elevation representation of a baseplate according to the first embodiment, with connecting system casings removed from the baseplate.

Identical, similar, or equivalent parts of the different figures bear the same reference numerals so as to facilitate switching from one figure to another.

FIG. 1 represents a baseplate 1 for a terminal block for a system for acquiring low voltage signals, for example current/voltage measuring signals in a medium or high voltage electrical facility. The baseplate 1 enables the female electrical connectors 7 to be mechanically and electrically connected to a terminal block (not represented).

Figure 3:
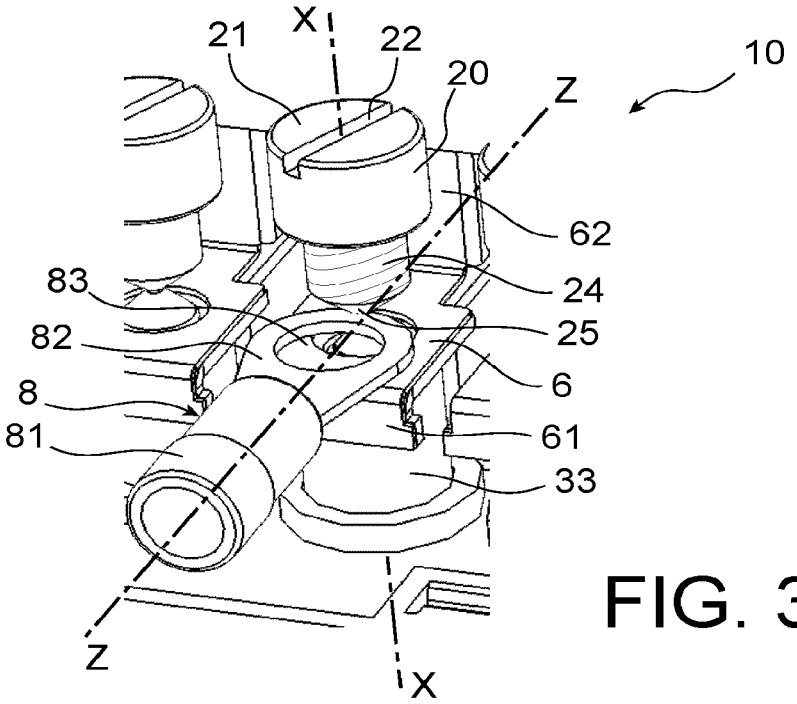
FIG. 3 is a partial elevation representation of a connecting system of the baseplate of the first embodiment, cooperating with a female electrical connector.

With reference to FIGS. 1 and 3 together, the represented female electrical connector 7 comprises a ring terminal 8. The ring terminal 8 comprises an end piece 81 from which a rim 82 delimiting a substantially circular ring 83 extends. The ring terminals 8 allow for a greater attachment security of the electrical connectors 7 to the baseplate 1.

The baseplate 1 includes a plurality of connecting systems 10 (FIG. 3) located inside a casing 3 and aligned on a front side 2 of the baseplate 1 along a longitudinal direction Y-Y of the baseplate 1, called an axial direction.

The axial direction Y-Y is substantially orthogonal to a height direction X-X of the baseplate and to a transverse direction Z-Z of the baseplate which are also substantially orthogonal to each other. In FIG. 1, the axial direction Y-Y substantially corresponds to a horizontal direction of the baseplate 1, the height direction XX to a vertical direction and the transverse direction Z-Z to the depth direction.

The baseplate 1 includes ring introducing aperture 4 opening onto the front side 2 along the transverse direction Z-Z. These apertures 4 are spaced apart from each other along the axial direction Y-Y.

The baseplate 1 also comprises upper ports 5 to introduce therein a tool for clamping the ring terminal 8. These upper ports 5 are spaced apart from the ports for introducing the ring terminal 4 along the height direction X-X.

Figure 4:
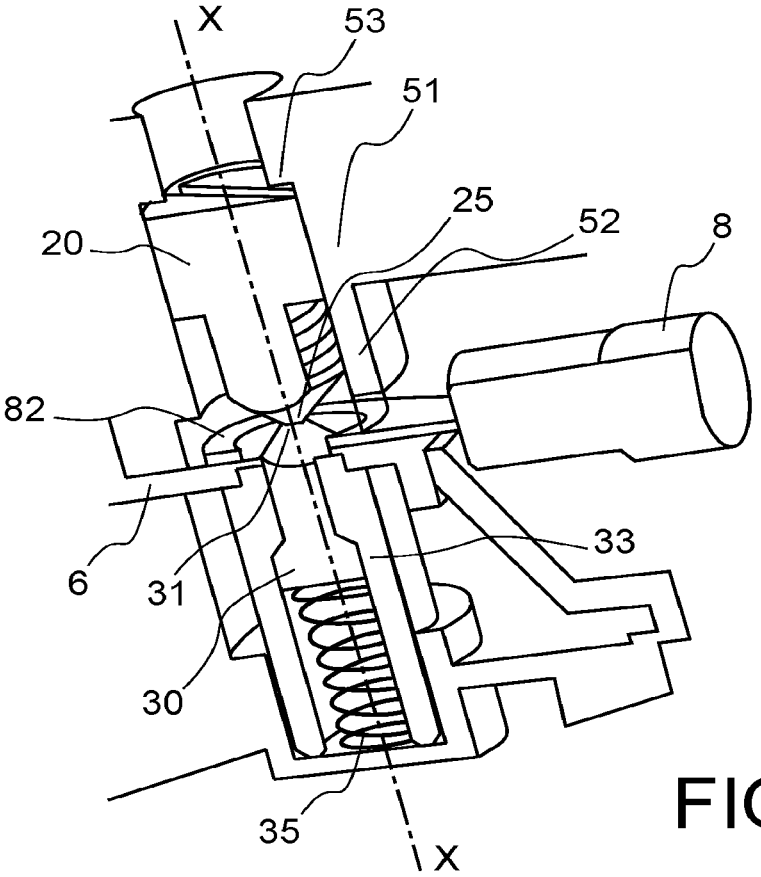
FIG. 4 is a vertical cross-section partial schematic representation of a ring terminal held by the holding means of a connecting system according to the invention.
Figure 5:
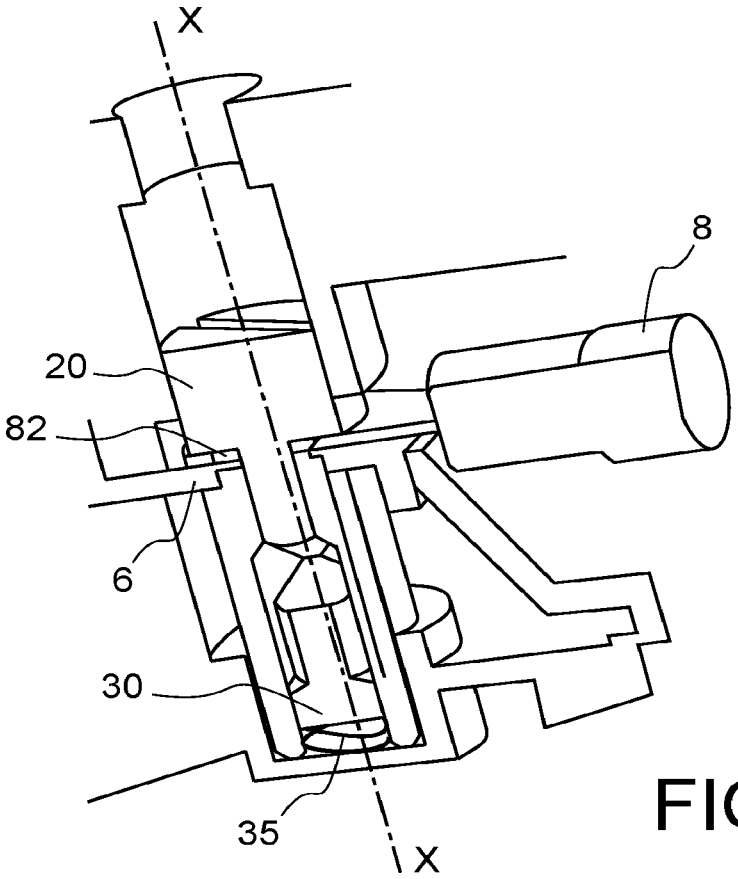
FIG. 5 a vertical cross-section partial schematic representation of a ring terminal clamped by the clamping means of a connecting system according to the invention.

With reference to FIGS. 3 to 5, the ring terminal 8 is able to be clamped/unclamped by acting on a clamping screw 20 from the upper port 5. The clamping screw 20 includes a head 21 through which passes a groove 22 for engaging the clamping tool such as a screwdriver (not represented). It also includes a threaded rod 24 terminated by a tip 25 opposite to the head along the longitudinal direction of the screw 20. The clamping screw 20 extends longitudinally along the height direction X-X.

This clamping screw 20 is for attaching the ring terminal 8 to support tab 6, once the ring terminal 8 is held with respect to this support tab 6 (FIGS. 4 and 5).

The clamping screw 20 is also able to be used as a first means for holding the ring terminal 8 relative to the support tab 6, as long as the ring terminal 8 is not attached to the tab 6.

With reference to FIG. 4, the clamping screw 20 is accommodated in a housing 51 comprising an upper abutment 53 formed by a narrowing in the diameter of the support port 5. This upper abutment 53 is used for holding the clamping screw 20 inside the casing 3. The risks of losing the clamping screw 20 are then cancelled, when the ring terminal 8 is separated from the connecting system 10.

This housing 51 includes a cylindrical wall 52 which forms a conduit for transitionally guiding the clamping screw 20 along the height direction X-X. The clamping screw 20 is maintained against its abutment 53 by the pressure exerted by the lower pin 30.

A circular aperture 63 which is sufficiently large for at least part of the clamping screw 20 and the lower pin 30 which is described below to pass therethrough passes through the support tab 6 between the upstream rim 61 and the downstream rim 62. The circular aperture 63 of the support tab is threaded complementarily to the thread of the support screw 20.

The support tab 6 is electrically conductive to electrically connect the ring terminal 8 to the terminal block. It is intended to be used as a support for the ring terminal 8 in a closing configuration. The ring terminal 8 consequently mechanically bears against the support tab 6.

The connecting system 10 includes a lower pin 30, the lower pin 30 and the clamping screw 20 being located on either side of the support tab 6 along the height direction X-X.

The lower pin 30 ends as a tip 31 towards the clamping screw 20. The tip of the lower pin 31 is for contacting that of the clamping screw 20, in particular in an opening configuration and a closing configuration. The pin 30 comprises a bottom, opposite to the tip 31, on which a spring 35 bears.

The lower pin 30 is designed to be used as a second holding means for the ring terminal 8 when it cooperates with the clamping screw 20 to hold the ring terminal 8 relative to the support tab 6, as long as it is not attached to the support tab 6.

The tips 25, 31 of the clamping screw 20 and the pin 30 are end portions whose cross-section orthogonal of the height direction X-X are narrowed towards the other of these holding means 20, 30, to facilitate the insertion of the ring terminal 8 between the clamping screw 20 and the pin 30.

The spring 35 bears against a first of its ends against the lower pin 30. It bears at its second end, opposite to the first end, against the base of a cylinder 33 surrounding the spring 35 and the pin 30. The spring 35 is a spring member working in compression to bias the lower pin 30 towards the clamping screw 20.

The cylinder 33 accommodates the lower pin 30 and the spring 35. The cylinder 33 is used for translationally guiding the lower pin 30 relative to the clamping screw 20 along the vertical direction X-X. The cylinder 33 is fixed with respect to the support tab 6.

The method for connecting the ring terminal 8 to the support tab 6 is described in further detail hereinafter.

Figure 6:
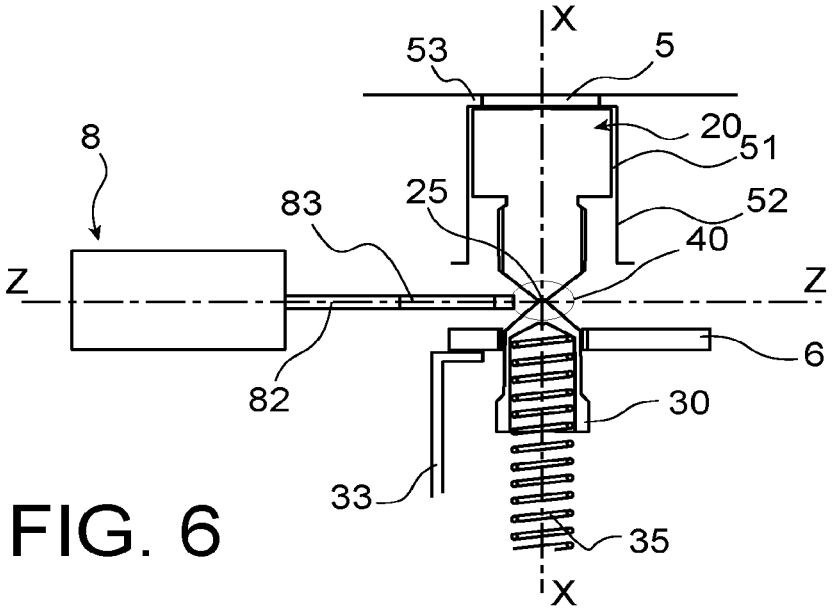
FIGS. 6 to 9 are vertical cross-section partial schematic representations illustrating the successive steps of connecting a ring terminal to a connecting system for a baseplate of a terminal block according to the first embodiment of the invention.

In FIG. 6, the ring terminal 8 is electrically and mechanically separated from the baseplate 1, in a first rest configuration which is also called an opening configuration. In this opening configuration, the female electrical connector 7 is electrically insulated from the connecting system 10.

The rim 82 of the ring terminal and its ring 83 are moved away from the tab 6 along the transverse direction Z-Z. The clamping screw 20 and the lower pin 30 are forced closer to each other, by the spring force of the spring 35 so as to define between them a first junction zone 40. In this junction zone 40, located at their respective tips 25, 51, the lower pin 30 and the clamping screw 20 bear against each other.

The clamping screw 20 is blocked in its housing 51 against the upper abutment 53, by being above the support tab 6. The upper portion of the lower pin 30 passes through the aperture 63 of the support tab 6.

Figure 7:
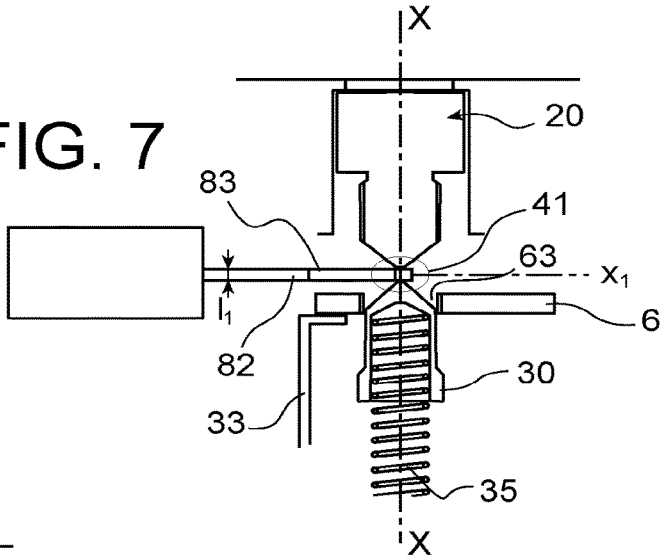

Between the configuration of FIG. 6 and that of FIG. 7, the ring terminal 8 has been moved along the transverse direction Z-Z towards the clamping screw 20 and the lower pin 30.

FIG. 7 represents an insertion configuration of the terminal 8 similar to that visible in FIG. 3.

In this figure, the ring terminal 8 is being inserted between the clamping screw 20 and the lower pin 30. The rim 82 of the terminal is bearing against the clamping screw 20 on the one hand and against the lower pin 30 on the other hand.

The rim 82 of the terminal biases the clamping screw 20 and the lower pin 30 away from each other, against the spring force of the spring 35. The tip 25 of the clamping screw 20 is moved away at most by the thickness $l_1$ of the rim 82. In practice, the clamping screw 20 remains blocked against the upper abutment 53 in its housing 51 and only the lower pin 30 has been moved relative to the support tab 6 with respect to the first rest configuration.

The clamping screw 20 and the lower pin 30 define between their respective tips 25, 31 a second junction zone 41 which is more extended along the height direction X-X than the first junction zone 40.

The ring 83 of the terminal is further offset along the transverse direction Z-Z of the clamping screw 20 and the lower pin 30.

Figure 8:
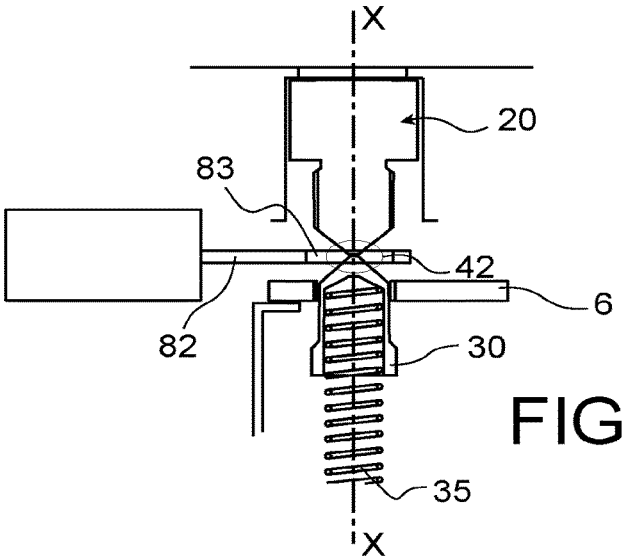

Between the configuration of FIG. 7 and that of FIG. 8, the ring 83 of the terminal has continued to be moved along the transverse direction Z-Z towards the clamping screw 20 and the lower pin 30.

FIG. 8 represents a configuration for holding the ring 8 similar to that visible in FIG. 4.

The clamping screw 20 and the lower pin 30 are moved close to each other along the height direction X-X, under the bias of the spring force of the spring 35. In practice, the clamping screw 20 remains blocked against the upper abutment 23 in its housing 51 and only the lower pin 30 has been moved with respect to the support tab 6 relative to the first rest configuration.

In FIG. 8, the connecting system 10 and the ring terminal 8 are in a second rest configuration. The clamping screw 20 and the lower pin 30 hold the ring terminal 8 relative to the support tab 6 and the clamping screw 20 has not yet been clamped in the aperture 63 of the support tab 6.

The clamping screw 20 and the lower pin 30 bear against each other through the ring 83 of the ring terminal. More precisely, the upper portion of the lower pin 30 or the lower portion of the threaded rod 24 pass through the aperture 63 of the support tab 6. The rim 82 of the ring, the clamping screw 20 and the lower pin 30 are substantially at the same height $x_1$ along the height direction X-X as in the first rest configuration.

The clamping screw 20 and the lower pin 30 define between their respective tips 25, 31 a third junction zone 42 with substantially the same extent along the height direction X-X as in the first junction zone 40.

Figure 9:
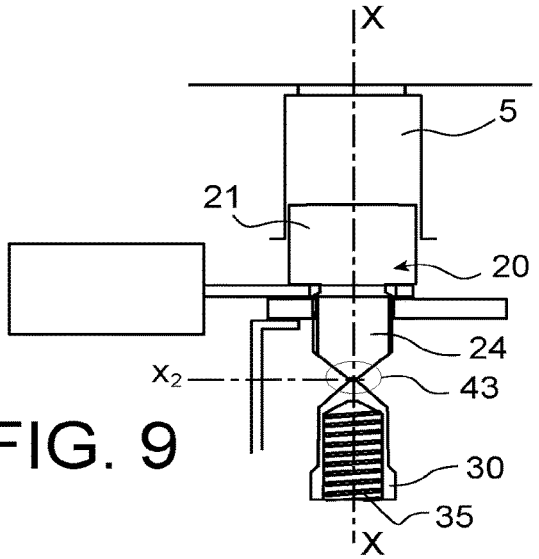

Between the configuration of FIG. 8 and that of FIG. 9, the ring terminal 8 has remained immobile along the transverse direction Z-Z relative to the support tab 6. The clamping screw 20 and the lower pin 30 have been moved along the height direction X-X downwardly, under the clamping effect of the screw 20 through the upper port 5, against the spring force of the spring 35.

The clamping screw 20 has been moved along the vertical direction off its housing 51 by bearing against the lower pin 30.

FIG. 9 represents a configuration for holding the ring 8 similar to that visible in FIG. 5.

In FIG. 9, the connecting system 10 and the ring terminal 8 are in a third rest configuration which is a closing configuration. In the closing configuration, the female electrical connector 7 is electrically connected to the terminal block.

The rim 82 of the ring is bearing against the head 21 of the clamping screw 20 on the one hand and against the support tab 6 on the other hand. The rod 24 of the clamping screw 20 passes through the aperture 63 of the support tab 6. The thread of the rod 24 cooperates with that of the aperture 63 of the tab 6 to attach the ring terminal 8 to the support tab 6 via the clamping screw 20.

The ring 83 of the terminal, the clamping screw 20 and the pin 30 are aligned along the height direction X-X. The entire lower pin 30 is located under the support tab 6.

The tips 25, 31 are still bearing against each other. The tips 25, 31 of the clamping screw 20 and of the pin 30 define a fourth junction zone 43 at a height $x_2$ along the height direction X-X which is lower than in the other configurations.

Of course, various modifications can be made by those skilled in the art to the invention just described in detail.

In the first rest configuration, the clamping screw 20 can be remote from the pin 30, provided that the gap between the clamping screw 20 and the pin 30 is sufficiently low with respect to the thickness $l_1$ of the rim 82 of the ring to enable the rim 82 to move the clamping screw 20 and the pin 30 away from each other when inserted between them.

The position of the clamping screw 20 and the pin 30 along the height direction X-X can be inverted.

The clamping screw 20 and the pin 30 can be aligned along an aligning direction tilted with respect to the vertical direction X-X, when biased towards each other by at least one spring member.

The spring 35 is likely to be replaced by other types of spring members such as a magnet if the lower pin 30 includes iron. The spring 35 can also be replaced by another elastic spring member such as an elastic polymer block.

The clamping screw 20 can also include a spring member configured to be biased towards the pin 30, in particular when it is not biased towards the pin 30 under the effect on its own weight.

The invention claimed is:

1. A connecting system for a ring terminal lug for a baseplate of a terminal block, wherein the ring terminal lug comprises an eyelet, wherein the connecting system comprises:

an electrical connecting member to be connected to the eyelet of the ring terminal lug, wherein the electrical connecting member comprises a support tab, wherein the ring terminal lug is configured to bear on the support tab;

first and second holders to hold the ring terminal lug through the eyelet, a spring member configured to bias the holders one towards the other;

wherein the connecting system is configured such that the ring terminal lug bearing against at least one of the holders and bearing on the support tab generates a relative gap of the holders one with respect to the other, wherein the connecting system is further configured to then move the holders closer to each other, under the bias of the spring member when the holders are located facing the eyelet of the terminal, so as to hold the ring terminal lug relative to the support tab, wherein a clamp for the terminal is configured to attach the ring terminal lug relative to the electrical connecting member, once the ring terminal lug is held by the holders, and wherein the support tab is located between the first holder and the second holder, and the support tab includes an aperture through which the first holder and the second holder are able to pass there through.

2. The connecting system according to claim 1, wherein the holders bear against each other through the eyelet of the ring terminal lug, when they hold the ring terminal lug relative to the electrical connecting member.

3. The connecting system according to claim 2, wherein at least one of the holders comprises an end portion the transverse cross-section of which is narrowed towards the other of the holders, to facilitate the insertion of the ring terminal lug between the holders.

4. The connecting system according to claim 1, wherein the system comprises a guide configured to guide the displacement of at least one of the holders towards the other of the holders.

5. The connecting system according to claim 1, wherein the system comprises a housing for at least one of the holders, where the holders is at least partially accommodated and maintained when the ring terminal lug is separated from the connecting system.

6. The connecting system according to claim 5, wherein the guide comprises a conduit.

7. The connecting system according to claim 1, wherein at least one of the holders comprises a screw.

8. A baseplate for a terminal block, wherein the baseplate comprises a plurality of connecting systems according to claim 1, wherein the connecting systems are aligned on at least one side of the baseplate and configured to mechanically and electrically connect ring terminal lug electrical connectors to the terminal block.

9. The connecting system according to claim 1, wherein an aperture of the support tab is threaded.

10. The connecting system according to claim 1, wherein at least one of the holders comprises a pin.

11. The connecting system according to claim 1, wherein the first and second holders contact each other through the eyelet such that a rim of the eyelet and the contacting portions of the first and second holders are substantially at a same height in the connecting system.

12. The connecting system according to claim 1, wherein the second holder is configured to pass through the support tab and through the eyelet of the ring terminal lug for holding the ring terminal lug relative to the baseplate.

13. The connecting system according to claim 1, wherein the first holder is configured to pass through the support tab and through the eyelet of the ring terminal lug for clamping the ring terminal lug relative to the baseplate.

14. The connecting system according to claim 1, wherein the second holder comprises a pin and the first holder comprises a screw.

15. The connecting system according to claim 1, wherein the first holder comprises a first longitudinal end and wherein the second holder comprises a second longitudinal end, and wherein the spring member is configured to bias the first longitudinal end and the second longitudinal end towards one another, so that the first longitudinal end is in contact with the second longitudinal end through the eyelet of the ring terminal lug and through the aperture of the support tab.

16. A method for connecting a ring terminal lug to a baseplate, by means of a connecting system for a ring terminal lug for a baseplate of a terminal block, wherein the ring terminal lug comprises an eyelet, wherein the connecting system comprises:

an electrical connecting member to be connected to the eyelet of the ring terminal lug, first and second holders to hold the ring terminal lug through the eyelet, a spring member configured to bias the holders one towards the other, wherein the connecting system is configured such that the ring terminal lug bearing against at least one of the holders generates a relative gap of the holders one with respect to the other, wherein the connecting system is further configured to then move the holders closer to each other, under the bias of the spring member when the holders are located facing the eyelet of the terminal, so as to hold the ring terminal lug relative to the connecting member, a clamp for the terminal configured to attach the ring terminal lug relative to the electrical connecting member, once the ring terminal lug is held by the holders, wherein the electrical connecting member includes a support tab which is located between the first holder and the second holder, and the support tab includes an aperture through which the first holder and the second holder are able to pass there through, wherein the ring terminal lug is configured to bear on the support tab, the method comprising:

inserting the ring terminal lug between the holders of the ring terminal lug, during which the ring terminal lug bears on at least one of the holders by moving the holders away from each other and the ring terminal lug bears on the support tab, moving the holders closer to each other, under the bias of the spring member, when the holders are located facing the ring terminal lug, wherein the second holder passes through the support tab and through the eyelet of the ring terminal lug for holding the ring terminal lug relative to the support tab of the connecting member, attaching the ring terminal lug relative to the support tab of the connecting member through clamping the first holder wherein the first holder passes through the support tab and through the eyelet of the ring terminal lug, once the ring terminal lug is held with respect to the support tab.

17. The method for connecting a ring terminal according to claim 16, wherein the holders are configured to bear against each other during the step of attaching the ring terminal lug through clamping.

18. The connecting system according to claim 16, wherein the clamp comprises the screw of the holders.

* * * * *